US008167682B2

(12) United States Patent
Kim et al.

(10) Patent No.: US 8,167,682 B2
(45) Date of Patent: May 1, 2012

(54) AUTOMATIC CONSTANT PRESSURE POLISHING APPARATUS FOR IMPROVING SURFACE ACCURACY OF LENS

(75) Inventors: Geonhee Kim, Daejeon (KR); Sunchoel Yang, Daejeon (KR); Myengsang Kim, Daejeon (KR); Kisoo Chang, Daejeon (KR); Hyosik Kim, Daejeon (KR)

(73) Assignee: Korea Basic Science Institute, Deajeon (KR)

( * ) Notice: Subject to any disclaimer, the term of this patent is extended or adjusted under 35 U.S.C. 154(b) by 671 days.

(21) Appl. No.: 12/302,747

(22) PCT Filed: Nov. 14, 2007

(86) PCT No.: PCT/KR2007/005704

§ 371 (c)(1),
(2), (4) Date: Nov. 26, 2008

(87) PCT Pub. No.: WO2008/060091

PCT Pub. Date: May 22, 2008

(65) Prior Publication Data

US 2009/0239449 A1 Sep. 24, 2009

(30) Foreign Application Priority Data

Nov. 15, 2006 (KR) ..... 10-2006-0112910

(51) Int. Cl.
*B24B 13/00* (2006.01)

(52) U.S. Cl. ..... 451/11; 451/505; 451/42

(58) Field of Classification Search ..... 451/42, 451/11, 269, 505, 504
See application file for complete search history.

(56) References Cited

U.S. PATENT DOCUMENTS

| | | | | |
|---|---|---|---|---|
| 5,205,083 | A * | 4/1993 | Pettibone | 451/42 |
| 5,255,474 | A * | 10/1993 | Gawa et al. | 451/295 |
| 5,762,546 | A * | 6/1998 | James et al. | 451/504 |
| 6,875,090 | B2 * | 4/2005 | Goulet et al. | 451/42 |
| 7,217,176 | B2 * | 5/2007 | Schneider et al. | 451/283 |

OTHER PUBLICATIONS

Patent Abstracts of Japan (1 pg): Japanese Publication No. 2002-361546; Filing Date: Dec. 18, 2002.
Patent Abstracts of Japan (1 pg): Japanese Publication No. 06-246619; Filing Date: Sep. 6, 1994.
Patent Abstracts of Japan (1 pg): Japanese Publication No. 2006-181659; Filing Date: Jul. 13, 2006.
International Search Report: International Application No. PCT/KR2007/005704; International Search Report mailing date: Feb. 18, 2008.

* cited by examiner

*Primary Examiner* — Robert Rose
(74) *Attorney, Agent, or Firm* — Staas & Halsey LLP

(57) ABSTRACT

Disclosed is an automatic constant pressure polishing apparatus. The automatic constant pressure polishing apparatus comprises a housing having a hollow section therein, a rubber pad installed in the housing and having superior expansion and contraction characteristics, a pressure fixture having a male screw section, which is formed on an outer peripheral surface thereof in order to press and fix the rubber pad, and a central hole formed at a central portion thereof, a slider screw-coupled into the housing to adjust pressure in the housing according to a rotational degree of the rotating shaft, and a polishing pad installed at a front end portion of the housing.

10 Claims, 5 Drawing Sheets

[Fig. 1]
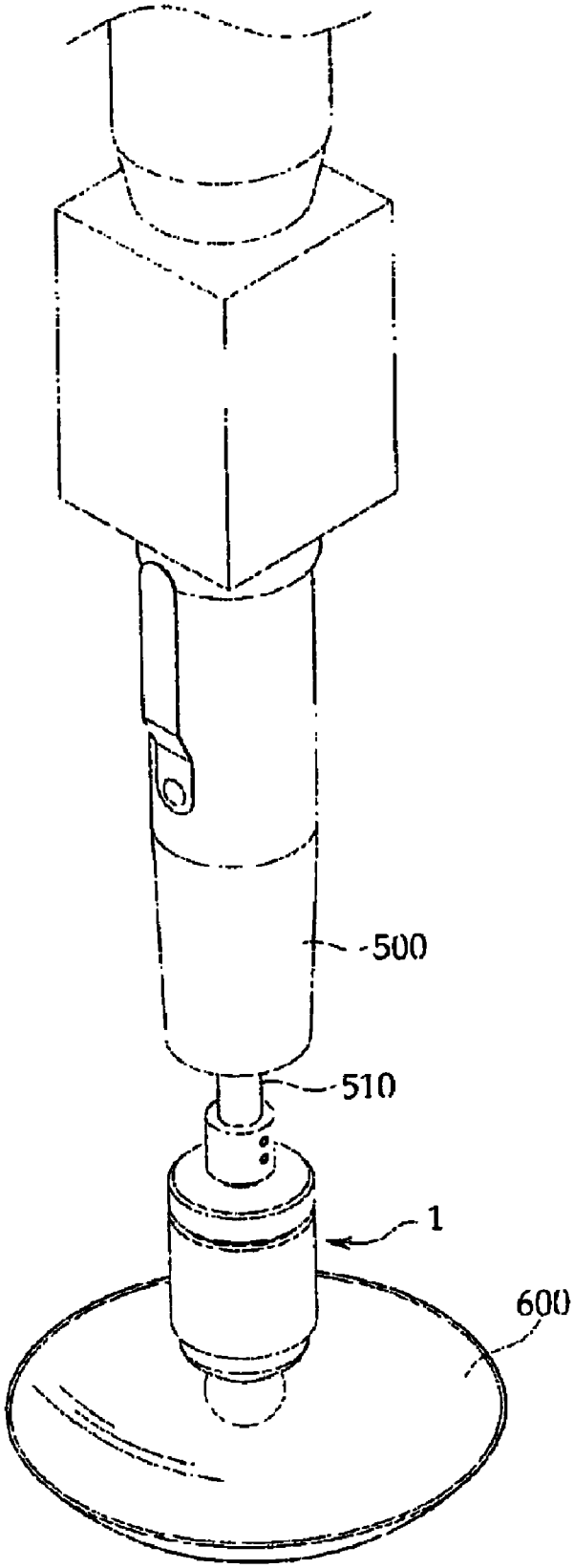

[Fig. 2]
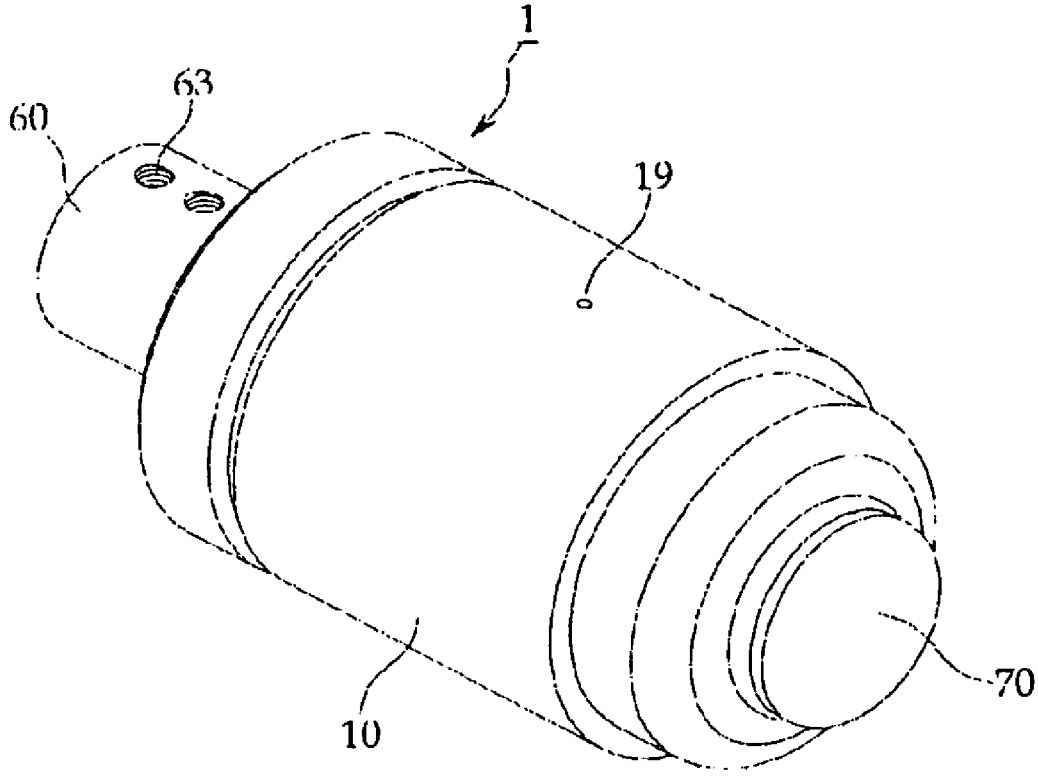

[Fig. 3]
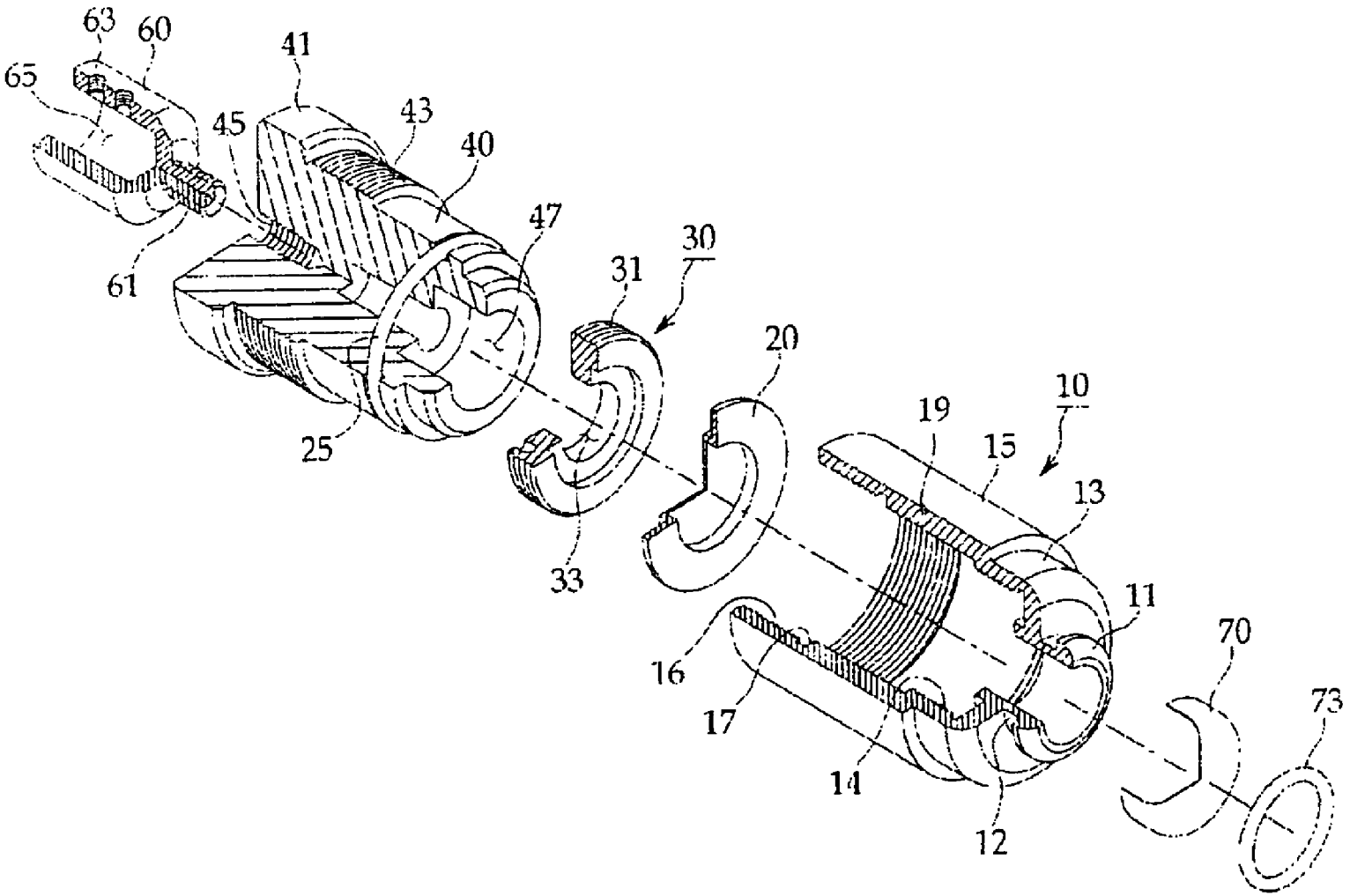

[Fig. 4]
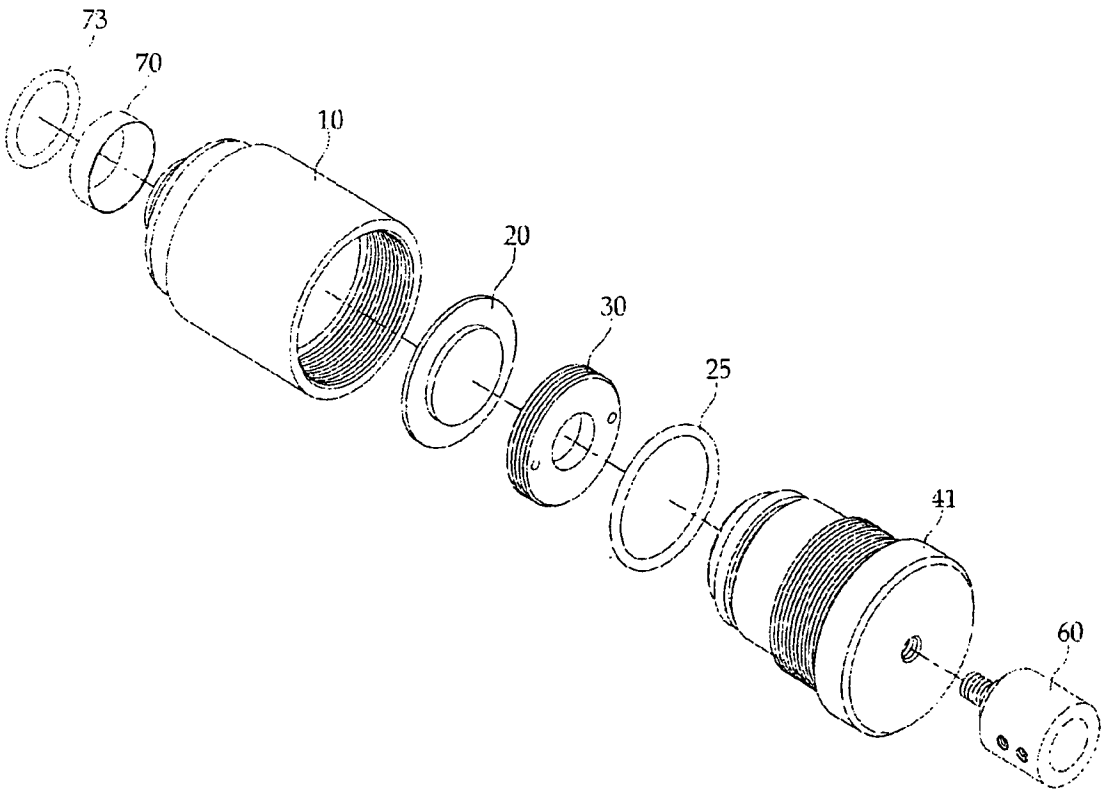
[Fig. 5]
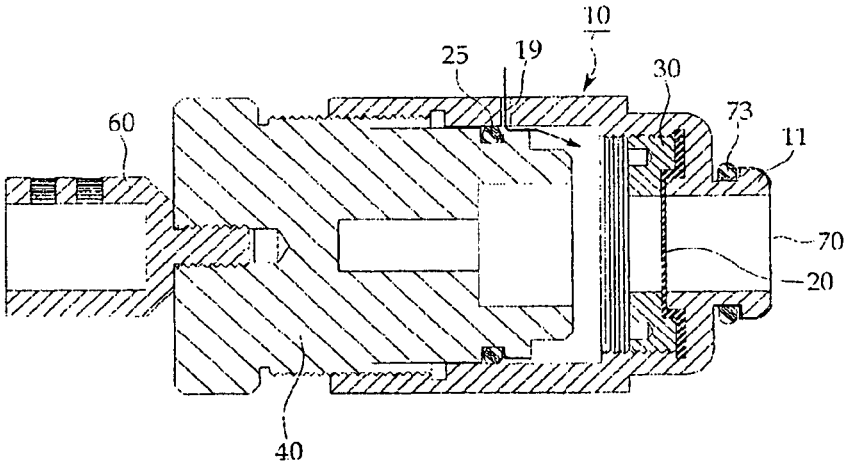

[Fig. 6]
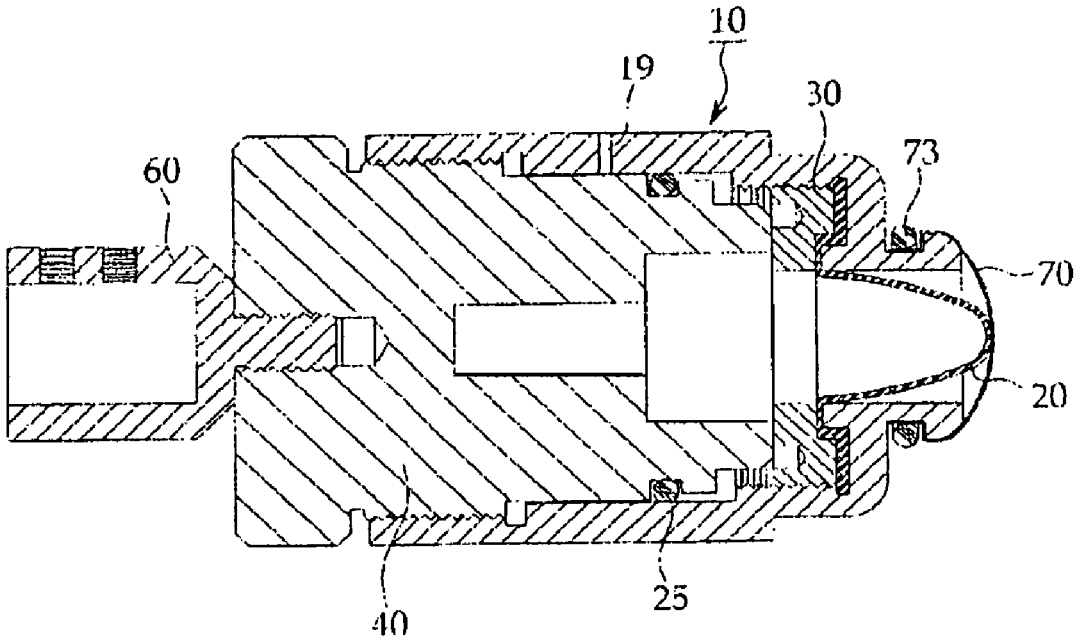

AUTOMATIC CONSTANT PRESSURE POLISHING APPARATUS FOR IMPROVING SURFACE ACCURACY OF LENS

CROSS REFERENCE TO RELATED APPLICATIONS

This application claims the benefit under 35 U.S.C. Section 371, of International Application No. PCT/KR2007/005704, filed Nov. 14, 2007, which claimed priority to Korean Application No. 10-2006-0112910, filed Nov. 15, 2006, in the Korean Intellectual Property Office, the disclosures of all of which are hereby incorporated by reference.

TECHNICAL FIELD

The present invention relates to an automatic constant pressure polishing apparatus for improving the surface accuracy of a lens. More particularly, the present invention relates to an automatic constant pressure polishing apparatus capable of performing fine polishing by maintaining constant pressure.

BACKGROUND ART

In general, various types of polishing apparatuses for polishing an optical lens have been placed on the market and technology for the polishing apparatuses has already been known in the art through various patents.

Such a polishing apparatus includes a polisher, which polishes scratches or rough portions on the surface of a lens by using a rotational force while making direct contact with the lens, as an important element.

However, since the conventional polishing apparatus has a simple structure equipped with a rigid polishing paper, a normal surface of a lens may also be damaged in addition to a rough portion of the lens. Further, since the polishing apparatus is rigid and the polishing paper is also rigid, the shape of the lens may be deformed because it is difficult to provide constant pressure.

Furthermore, since pressure adjustment of the polishing apparatus is difficult, nano-level fine polishing cannot be performed. Moreover, since much time is required to set the polishing apparatus, a user feels inconvenienced when using the polishing apparatus.

DISCLOSURE

Technical Problem

The present invention has been made to solve the above problems occurring in the prior art, and an object of the present invention is to provide an automatic constant pressure polishing apparatus for improving the surface accuracy of a lens, which can perform fine polishing by constantly maintaining the pressure of the polishing apparatus making contact with the lens.

Another object of the present invention is to provide an automatic constant pressure polishing apparatus for improving the surface accuracy of a lens, which can enhance polishing performance by applying constant pressure over the entire surface of a polishing pad mounted on the polishing apparatus.

Further another object of the present invention is to provide an automatic constant pressure polishing apparatus for improving the surface accuracy of a lens, which can polish a thin lens such as a soft lens.

Technical Solution

In order to accomplish the above object, according to one aspect of the present invention, there is provided an automatic constant pressure polishing apparatus comprising: a housing having a hollow section therein; a rubber pad installed in the housing and having superior expansion and contraction characteristics; a pressure fixture having a male screw section, which is formed on an outer peripheral surface thereof in order to press and fix the rubber pad, and a central hole formed at a central portion thereof; a slider screw-coupled into the housing to adjust pressure in the housing according to a rotational degree of the rotating shaft; and a polishing pad installed at a front end portion of the housing.

The housing comprises a polishing pad mounting section, the pressure fixture mounting section and the slider mounting section sequentially formed from the front end portion of the housing.

The polishing pad mounting section has an inside diameter smaller than an inside diameter of the pressure fixture mounting section, and the pressure fixture mounting section has an inside diameter smaller than an inside diameter of the slider mounting section.

The polishing pad mounting section has a hollow section therein and a slot formed on an outer peripheral surface thereof, and the polishing pad is fastened by installing a pad fixing ring in the slot.

The pressure fixture mounting section is formed on an inner peripheral surface thereof with a first screw section corresponding to a male screw section of the pressure fixture.

The slider mounting section has a second screw section on an inner peripheral surface at a rear end portion thereof, and a fluid supply hole is formed at a middle portion of a cylindrical wall of the slider mounting section.

The slider has a fluid storage groove therein and a flange formed at a rear end portion thereof, a male screw section is formed at a body of the slider adjacent to the flange, and an O-ring for sealing fluid is provided between the male screw section and a front end portion of the slider.

DESCRIPTION OF THE DRAWINGS

The above and other advantages of the present invention will become readily apparent with reference to the following detailed description when considered in conjunction with the accompanying drawings wherein:

FIG. 1 is a perspective view illustrating the use of an automatic constant pressure polishing apparatus according to the present invention;

FIG. 2 is a perspective view of an automatic constant pressure polishing apparatus according to the present invention;

FIG. 3 is a front exploded perspective view of the automatic constant pressure polishing apparatus of FIG. 2;

FIG. 4 is a rear exploded perspective view of the automatic constant pressure polishing apparatus of FIG. 2; and FIG. 5 is a sectional view illustrating the operational state of an automatic constant pressure polishing apparatus according to the present invention.

FIG. 6 is a sectional view illustrating the operational state of an automatic constant pressure polishing apparatus according to the present invention.

BEST MODE

Hereinafter, an automatic constant pressure polishing apparatus for improving the surface accuracy of a lens according to the present invention will be explained in detail with reference to the accompanying drawings.

FIG. 1 is a perspective view illustrating the use of the automatic constant pressure polishing apparatus according to the present invention, FIG. 2 is a perspective view of the automatic constant pressure polishing apparatus according to the present invention, FIG. 3 is a front exploded perspective view of the automatic constant pressure polishing apparatus of FIG. 2, FIG. 4 is a rear exploded perspective view of the automatic constant pressure polishing apparatus of FIG. 2, FIG. 5 is a sectional view illustrating the operational state of the automatic constant pressure polishing apparatus according to the present invention, and FIG. 6 is a sectional view illustrating the operational state of the automatic constant pressure polishing apparatus according to the present invention.

As shown in FIG. 1, the automatic constant pressure polishing apparatus 1 according to the present invention is mounted at a grinding tool 500 to polish a lens 600 to be processed (hereinafter, simply referred to as a lens) In detail, the automatic constant pressure polishing apparatus is mounted at a rotating shaft 510 of the grinding tool 500 to polish the lens 600 while rotating together with the rotating shaft 510.

Referring to FIGS. 2 to 4, the automatic constant pressure polishing apparatus 1 according to the present invention comprises a housing 10 having a hollow section therein, a rubber pad 20 installed in the housing 10, a pressure fixture 30 for pressing and fixing the rubber pad 20, a slider 40 and a polishing pad 70 installed at the front end portion of the housing 10. The slider 40 is screw-coupled into the housing 10 to adjust pressure in the housing 10 according to the rotational degree of the rotating shaft 510.

An adapter 60 is installed at the rear end portion of the slider 40 to couple the automatic constant pressure polishing apparatus of the present invention to the rotating shaft 510 of the grinding tool 500.

The polishing pad 70 may include a polishing cloth generally used and may also be manufactured in the form of a smooth cloth or a thin non-woven fabric.

In the following description, the front end portion indicates a part at which the polishing pad is seated, and the rear end portion indicates a part at which the grinding tool is provided.

In more detail, the housing 10 has a hollow section therein. In addition, a polishing pad mounting section 11, a pressure fixture mounting section 13 and a slider mounting section 15 are sequentially formed from the front end portion of the housing 10. The polishing pad mounting section 11, the pressure fixture mounting section 13 and the slider mounting section 15 are integrally formed with each other to constitute the housing 10.

The polishing pad mounting section 11 has an inside diameter smaller than that of the pressure fixture mounting section 13. The pressure fixture mounting section 13 has an inside diameter smaller than that of the slider mounting section 15.

The polishing pad mounting section 11 has a hollow section therein and a slot 12 formed on the outer peripheral surface thereof. The polishing pad 70 is arranged at the polishing pad mounting section 11 in such a manner that the polishing pad 70 seals the polishing pad mounting section 11. The polishing pad 70 is fastened by installing a pad fixing ring 73 in a slot 12.

The pressure fixture mounting section 13 has a first screw section 14 formed on the inner peripheral surface thereof. In addition, the pressure fixture 30 is formed on the outer peripheral surface thereof with a male screw section 31 corresponding to the first screw section 14, and a central hole formed at the central portion thereof. In such a structure, the male screw section 31 of the pressure fixture 30 is screw-coupled into the first screw section 14 of the pressure fixture mounting section 13, so that the rubber pad 20 is compressed and fixed.

Preferably, the rubber pad 20 comprises elastic rubber material having superior expansion and contraction characteristics, and can be easily expanded downward as pressure of fluid, such as water, is applied thereto.

The slider mounting section 15 is formed on the inner peripheral surface of the rear end portion thereof with a second screw section 16, and a stopper 17 is formed at the inner end portion of the second screw section 16. Further, a fluid supply hole 19 is formed at the middle portion of a cylindrical wall of the slider mounting section 15. The fluid supply hole 19 is used to provide fluid, such as water, to the inner side of the housing 10.

The slider 40 is mounted at the slider mounting section 15. The slider 40 is a body having a fluid storage groove 47 therein, and includes a flange 41 at the rear end portion of the slider 40. A male screw section 43 is formed at the body of the slider 40 adjacent to the flange 41. Further, an O-ring for sealing fluid is provided between the male screw section 43 and the front end portion of the slider 40.

A female screw hole 45 may be integrally formed at the rear central portion of the slider 40, and the adapter 60 is screw-coupled into the female screw hole 45. The adapter 60 has a male screw section 61, which corresponds to the female screw hole 45, at the front end portion thereof, an insertion hole 65 at the inner portion thereof, and screw holes 63 at the outer peripheral surface thereof.

Accordingly, the rotating shaft 510 of the grinding tool 500 is inserted into the insertion hole 65 and then fixing members such as bolts are inserted into the screw holes 63, so that the adapter 60 can be fixed to the rotating shaft 510.

Hereinafter, the automatic constant pressure polishing apparatus for improving the surface accuracy of the lens according to the present invention will be explained in detail.

As shown in FIG. 5, the polishing pad 70 is mounted at the polishing pad mounting section 11 of the housing 10. The rubber pad 20 is seated on the inner front end portion of the housing 10, and then the pressure fixture 30 is screw-coupled into the pressure fixture mounting section 13, so that the rubber pad 20 is compressed and fixed.

Thereafter, the slider 40 is screw-coupled with the slider mounting section 15. At first, water or fluid corresponding to the water is supplied to the housing 10 through the fluid supply hole 19 as indicated by an arrow in a state in which the slider 40 slightly moves forward. As a predetermined amount of the water or fluid has been supplied to the housing 10, the slider 40 more moves forward through the screw coupling.

Then, the outer peripheral surface of the slider 40 blocks the fluid supply hole 19, so that the water or fluid supplied to the housing 10 is prevented from being discharged through the fluid supply hole 19. In particular, the O-ring 25 mounted on the outer peripheral surface of the slider 40 performs a sealing function to prevent the water or fluid from being discharged to the outside of the housing 10.

As the slider 40 moves forward in the housing 10, the rubber pad 20 having superior expansion and contraction characteristic pushes the polishing pad 70 in the front direction while being expanded forward due to increase of pressure in the housing 10 as shown in FIG. 6. Accordingly, the polishing pad 70 has a shape suitable for polishing the lens.

In addition, the pressure in the housing 10 can be adjusted by slightly rotating the slider 40 in a forward or backward direction, so that the strength or pressure of the polishing pad 70 can be adjusted.

In such a state, the adapter 60 is fitted around the rotating shaft 510 of the grinding tool 500. Thus, as the rotating shaft 510 rotates, the adapter 60 also rotates, so that the automatic constant pressure polishing apparatus 1 also rotates. As a result, the lens is polished.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

INDUSTRIAL APPLICABILITY

As described above, according to the automatic constant pressure polishing apparatus for improving the surface accuracy of a lens of the present invention, constant pressure is applied over the entire surface of the polishing pad, so that fine polishing can be performed and the polishing quality can also be improved.

Further, a thin lens such as a soft lens can be polished and the polishing time can be significantly shortened.

The invention claimed is:

1. A automatic constant pressure polishing apparatus comprising:

a housing having a hollow section therein;

a rubber pad installed in the housing and having superior expansion and contraction characteristics;

a pressure fixture having a male screw section, which is formed on an outer peripheral surface thereof in order to press and fix the rubber pad, and a central hole formed at a central portion thereof;

a slider screw-coupled into the housing to adjust pressure in the housing according to a rotational degree of a rotating shaft; and a polishing pad installed at a front end portion of the housing.

2. The automatic constant pressure polishing apparatus as claimed in claim 1, wherein the housing comprises a polishing pad mounting section, the pressure fixture mounting section and the slider mounting section sequentially formed from the front end portion of the housing.

3. The automatic constant pressure polishing apparatus as claimed in claim 2, wherein the polishing pad mounting section has an inside diameter smaller than an inside diameter of the pressure fixture mounting section, and the pressure fixture mounting section has an inside diameter smaller than an inside diameter of the slider mounting section.

4. The automatic constant pressure polishing apparatus as claimed in claim 2, wherein the polishing pad mounting section has a hollow section therein and a slot formed on an outer peripheral surface thereof, and the polishing pad is fastened by installing a pad fixing ring in the slot.

5. The automatic constant pressure polishing apparatus as claimed in claim 2, wherein the pressure fixture mounting section is formed on an inner peripheral surface thereof with a first screw section corresponding to a male screw section of the pressure fixture.

6. The automatic constant pressure polishing apparatus as claimed in claim 2, wherein the slider mounting section has a second screw section on an inner peripheral surface at a rear end portion thereof, and a fluid supply hole is formed at a middle portion of a cylindrical wall of the slider mounting section.

7. The automatic constant pressure polishing apparatus as claimed in claim 1, wherein the slider has a fluid storage groove therein and a flange formed at a rear end portion thereof, a male screw section is formed at a body of the slider adjacent to the flange, and an O-ring for sealing fluid is provided between the male screw section and a front end portion of the slider.

8. The automatic constant pressure polishing apparatus as claimed in claim 3, wherein the polishing pad mounting section has a hollow section therein and a slot formed on an outer peripheral surface thereof, and the polishing pad is fastened by installing a pad fixing ring in the slot.

9. The automatic constant pressure polishing apparatus as claimed in claim 3, wherein the pressure fixture mounting section is formed on an inner peripheral surface thereof with a first screw section corresponding to a male screw section of the pressure fixture.

10. The automatic constant pressure polishing apparatus as claimed in claim 3, wherein the slider mounting section has a second screw section on an inner peripheral surface at a rear end portion thereof, and a fluid supply hole is formed at a middle portion of a cylindrical wall of the slider mounting section.

* * * * *